United States Patent [19]

Wagner

[11] Patent Number: 4,607,546

[45] Date of Patent: Aug. 26, 1986

[54] POWER WRENCH

[76] Inventor: Paul-Heinz Wagner, Haus Nr. 70, D-5203 Much-Birrenbachshöhe, Fed. Rep. of Germany

[21] Appl. No.: 629,235

[22] Filed: Jul. 9, 1984

[30] Foreign Application Priority Data

Jul. 8, 1983 [DE] Fed. Rep. of Germany ... 8319734[U]

[51] Int. Cl.[4] ..... B25B 13/46

[52] U.S. Cl. ..... 81/57.39

[58] Field of Search ..... 81/57.16, 57.34, 57.39, 81/57.4

[56] References Cited

U.S. PATENT DOCUMENTS 3,972,242 8/1976 Hunt ..... 81/57.39

4,309,923 1/1982 Wilmeth ..... 81/57.39 X 4,385,533 5/1983 Collins ..... 81/57.39

*Primary Examiner*—James G. Smith

*Attorney, Agent, or Firm*—Diller, Ramik & Wight

[57] ABSTRACT

A power wrench which includes a driving unit for driving a wrench head, a casing for the driving unit, a support foot carried nonrotatably by the casing for offsetting reaction forces created by the driving unit, a pressure member, a spherical ball and socket connection between the pressure member and the support foot whereby the pressure member automatically assumes a position in total contact with a support surfaces to avoid local peak stresses during the operation of the power wrench, the casing including a polygonal peripheral outer surface profile, and the support foot having a slide ring whose profile is formed by faces which engage and effectively lock against those of the casing.

21 Claims, 3 Drawing Figures

POWER WRENCH

The invention relates to a power wrench comprising a driving unit for driving a wrench head having a rotatably supported ring with an out-of-round connecting element to be slipped on a wrench head or a button die, and a support foot nonrotatingly mounted at the casing of the driving unit for leading off the reaction force.

Power wrenches of the manually drivable design as well as those containing a hydraulic driving unit have been known. They are used to tighten or unscrew nuts and screws having a high torque. If such a torque is exerted on the screw head via the wrench head, it is necessary for the casing of the driving unit to be supported at a stationary abutment so as to avoid its concomitant rotation. The casing of the driving unit is supported by a foot which, as a rule, projects radially or tangentially from the casing.

The abutment against which the support foot is applied may be an adjacent screw, flange or another constructional element of the assembly including the screw or nut to be tightened. Therefore, the place of said abutment and of its support surface is not predefined thus conditioning a support foot design which, subject to the local circumstances, may find is support at different points. Further, the angular position of the support surface of the abutment cannot be predetermined either.

There have been also known hydraulically driven power wrenches comprising a piston-cylinder unit for performing a number of strokes to rotate stepwise the screw head via a ratchet present in the wrench head. The casing of the driving unit of such power wrenches may perform swivel movents responsive to the respective piston stroke. A support foot secured to the casing should be adaptable to such swivel movements.

It is the object of the invention to provide a power wrench of the above identified type which is able to adapt its support foot to the prevailing local conditions so as to allow, with different angle positions relative to the respective stationary abutment, to transmit the reaction force via a surface to the abutment thus avoiding concentrations of compressive stresses.

To solve this problem, the invention provides that the support foot comprises a pressure member supported rotatably and having a projecting contact surface.

As a result, the contact surface of the pressure member is adapted to the respective support surface of the stationary abutment thus ensuring that the reaction force is always transmitted via the contact surface to the full abutment area. If the stationary abutment contains an edge, the support is not effected there but at an adjacent surface against which the contact surface of the pressure member may bear. By this means, inadmissible high surface pressures and deformations are avoided at the support foot and at the stationary abutment because the pressure is always transmitted through a surface.

In an advantageous embodiment of the invention, the casing contains for the support foot a longitudinal guideway extending transversely to the axis of the connecting element and from which the support foot protrudes in parallel to the axis of the connecting element. This variant particularly lends itself to hydraulically operated power wrenches having a driving unit extending at right angles to the axis of the connecting element. As a rule, the support foot is adapted to project tangentially from the casing of the driving unit. Due to the spherically supported pressure member, it is possible to adapt the contact surface to any desired support surface.

Preferably, the profile of the casing is polygonal to slip thereon a slide ring of the support foot, the slide ring being movable in longitudinal direction of the casing thus permitting to place the support foot against a suitable abutment. The polygonal profile is responsible for the peripheral distribution of torsion stresses which are exerted on the driving unit casing by the support foot. Due to a hexagonal profile, the support foot may be displaced each time by 60° so as to adapt it to the prevailing support conditions. If the slide ring is provided with an internal double hexagonal profile, the support foot can be displaced each time by 30°. A double hexagonal profile consists of two hexagonal profiles offset peripherally by 30° to result in a twelve-pronged star.

According to a preferred embodiment of the invention, the shape of the support foot is triangular, two legs of the triangle changing over substantially tangentially into a slide ring being slippable onto the casing. The triangular support foot design contributes to its increased rigidity and stability. A spherically supported pressure member is provided at one leg at least.

In contradistinction to the hinged supports employed occasionally and which are pivotable about one sole axis at the driving unit casing, the risk of unintentional sliding from the stationary abutment is reduced according to the invention with the use of the support foot with spherically seated pressure member. The pivot centre of the pressure member is spaced slightly from the abutment, so that the reaction force is transmitted directly from the spherical surface of the pressure member to the support foot nonrotatingly connected to the driving unit casing, whereby oscillating elements as well as effort arms are avoided.

According to a second solution to the problem of the invention, the casing contains an out-of-round polygonal profile extending transversely to the axis of the connecting element to slip thereon a slide ring of the support foot so as to be torsion-proof in various angle of rotation positions.

Some embodiments of the invention are explained hereunder in more details with reference to the drawings.

Figure 1:
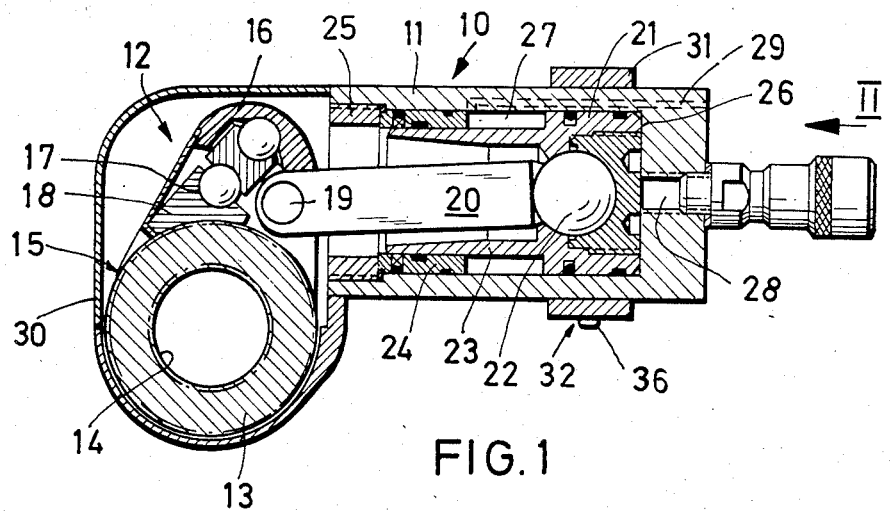
FIG. 1 is a longitudinal section of an embodiment of the power wrench

The illustrated power wrench comprises a hydraulically operated driving unit 10 having an elongated casing 11 and driving through a ratchet system 12 a pivoted ring 13 which contains a connecting element 14 in the form of an aperture designed as a polygonal or toothed profile. It is for inst. possible to provide in the connecting element 14 a button die to receive thereon a screw head. Ring 13 forms part of the wrench head 15 which comprises a lever arm 16 supported coaxially to ring 13. Inside the lever arm 16, a toggle lever system 17 with a toothed segment 18 engages an external toothing of ring 13. The toggle lever system 17 together with the toothed segment 18 form the ratchet mechanism 12 due to which, with a swivel movement of lever arm 16 counterclockwise, the ring 13 is entrained while if the swivel movement of the lever arm 16 is clockwise, the ring is not taken along.

Via a joint 19, the piston rod 20 of the driving unit 10 engages the lever arm 16. Within the casing 11 forming also the hydraulic cylinder, the driving unit 10 contains an axially displaceable piston 21, housing a spherical part 22 to which the piston rod 20 is secured. A sleeve 23 enclosing the piston rod 20 at a radial distance and projecting from the end of the piston 21 is sealingly guided in a bearing bushing 24 disposed in casing 11, the bearing bushing 24 finding its support at a hollow thread ring 25 screwed into the end of casing 11.

Figure 2:
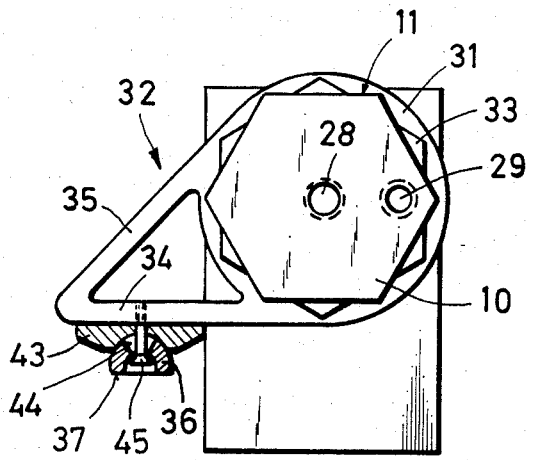
FIG. 2 is a view if a power wrench similar to that of FIG. 1, from the direction of arrow II.

As illustrated in FIG. 1, the piston 21 takes its return position in which the volume of the rearward cylinder chamber 26 is at its minimum or zero, while the volume of the front cylinder space 27 is at its maximum. Through the end wall of casing 11 in the front cylinder space 26, there extends a hydraulic conduit 28, while hydraulic conduit 29 extends into the front cylinder chamber 27. The hydraulic conduit 28 extends along the axis of the casing 11, while hydraulic conduit 29 of FIG. 2 is provided near one edge of the casing 11 having an external hexagonal shape. By this means it is possible to provide without any trouble the connections of both hydraulic lines 28 and 29 at the end wall of casing 11.

The wrench head casing 30 including ring 13 and lever arm 16 is mounted at the casing 11 and closed in all round. However, its sides contain openings to pass therethrough the shaft of a button die to engage the connecting element 14. Slide ring 31 of the support foot 32 being slipped on the hexagonal outer contour of the casing 11 is provided with a double hexagonal inner profile 33 which consists of two hexagonal profiles offset by 30° thus forming a regular twelve-pronged star. The double hexagonal profile 33 can be slipped on the hexagonal profile of casing 11 whereby only every second corner of the double hexagonal profile 33 is filled by a corner of casing 11, while the intermediate corners are unused. Ring 31 may be slipped in different positions of rotation on the outer hexagonal profile of casing 11, the feasible angle of rotation positions differing by 30° in each case.

Two legs 34,35 projecting tangentially from ring 31 extend at a mutual angle of about 30° to form with the intermediate section of the slide ring 31 a triangle.

Figure 3:
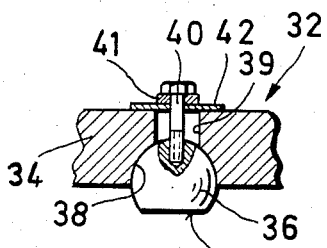
FIG. 3 is a scaled-up view of a part-section of the support foot of FIG. 1.

The pressure member 36 mounted spherically at the outside of the leg 34 contains a contact surface 37 to place thereagainst a stationary abutment. In the instant case, the pressure member 36 consists of a ball flattened within the reach of the plane contact surface 37 which, as evident from FIG. 3, is disposed in a spherical recess 38 of the leg 34 of the support arm 32. A screw 40 screwed into the pressure member 36 extends through a bore 39 of the leg 34, the axis of said screw 40 being rectangular relative to the contact surface 37, while the head of the screw 40 is supported through a flexible plate 41 on a plate 42 bridging the rearward end of the bore 39. The diameter of the bore 39 is as large as to enable the shaft of the screw 40 to take different angle positions during the rotation of the spherical pressure member 36, the length being compensated by the flexible plate 41.

When the power wrench is in use, the support foot 32 with the contact surface 32 is placed against a support surface of a (non-illustrated) stationary abutment after the connecting element 14 has been connected nonrotatingly to the wrench head. At the same time, the pressure member 36 automatically takes the position to ensure that the contact surface 37 flatly adjoins the abutment. Thus, by distributing the supporting force over the total contact surface 37, local peak stresses are avoided.

In the embodiments of FIGS. 1 and 3, the pressure member 36 is positioned in a bore 39 at a determined point of the leg 34. It is also possible to provide in place of the bore 39 an elongated slot to permit the displacement of the pressure member 36. If so, a troughshaped channel with arcuate walls should be provided instead of the spherical recess 38 supporting the ball surface.

As obvious from FIG. 3, the pressure member 36 may be swivelled around two axes extending at right angles relative to each other and passing through the ball center, and, in addition around the axis of screw 40. The contact surface 37 projects beyond the underside of leg 34 thus ensuring that the pressure member 36 finds a stop at the abutment without being hindered by leg 34.

According to the embodiment of FIG. 2, the spherical pressure member 36 is mounted at the leg 34 through a block 43 which is fastened at the outside of said leg 34. The block 43 comprises a spherical recess to seat the spherical pressure member 36, which contains the head of a screw 45. The shaft of said screw 45 is passed through a circular opening 44 of the pressure member 36 into a thread bore of leg 34. It is possible to swivel the pressure member 36 around the head of the screw firmly joined to leg 34, so that its contact surface 37 may occupy various angle positions relative to the leg 34. It is not necessary to fix the block 43 at the leg 34, it will also be convenient to press it by screw 45 and pressure member 36 against the outside of leg 34. In such a case, several thread bores may be provided at the leg 34 to secure thereto the pressure member 36 together with the block 43 in various positions. The head of the screw 45 is accessible through an opening in the contact surface 37 of the pressure member 36 to apply a screw tightener.

What is claimed is:

1. A power wrench comprising driving unit means for driving a wrench head, a hollow casing for internally housing said driving unit means, a support foot carried non-rotatably by said casing for offsetting reaction forces created by said driving unit means, a pressure member, and means for defining a spherical ball and socket connection between said pressure member and said support foot whereby said pressure member automatically assumes a position in total contact with a support surface to avoid local peak stresses during the operation of said power wrench, said casing includes a polygonal peripheral profile, and said support foot includes means having a profile for slidable nonrotatable locking engagement with and removal from said casing peripheral profile.

2. The power wrench as defined in claim 1 wherein said pressure member has a relatively flat contact surface.

3. The power wrench as defined in claim 1 wherein said driving unit means includes a rotatable ring with an out-of-round connecting element adapted to be slipped upon a wrench head or the like, said casing includes a longitudinal guideway for said support foot extending transversely to the axis of said connecting element and from which said support foot projects in parallel to said connecting element axis.

4. The power wrench as defined in claim 1 wherein said slidable nonrotatable locking and removal means includes a slide ring of said support foot having a profile to lockingly engage with at least portions of said casing polygonal peripheral profile.

5. The power wrench as defined in claim 1 wherein said slidable nonrotatable locking and removable means includes a slide ring, said support foot is generally triangular and includes two legs diverging toward said slide ring, and said slide ring has an inner profile adapted to lockingly engage with said polygonal peripheral profile of said casing.

6. The power wrench as defined in claim 2 wherein said driving unit means includes a rotatable ring with an out-of-round connecting element adapted to be slipped upon a wrench head or the like, said casing includes a longitudinal guideway for said support foot extending transversely to the axis of said connecting element and from which said support foot projects in parallel to said connecting element axis.

7. The power wrench as defined in claim 2 wherein said slidable nonrotatable locking and removal means includes a slide ring of said support foot having a profile whose faces are in excess of the faces of said casing polygonal peripheral profile thereby effecting locking engagement between less than all of said faces.

8. The power wrench as defined in claim 1 wherein said slidable nonrotatable locking and removal means includes a slide ring having an inner double hexagonal profile.

9. The power wrench as defined in claim 2 wherein said slidable nonrotatable locking and removal means includes a support ring, said support foot is generally triangular and includes two legs diverging toward said slide ring, and said slide ring has an inner profile adapted to lockingly engage with said outer peripheral profile of said casing.

10. The power wrench as defined in claim 3 wherein said slidable nonrotatable locking means includes a slide ring of said support foot having a profile to lockingly engage with at least portions of said casing polygonal peripheral profile.

11. The power wrench as defined in claim 3 wherein, and said slidable nonrotatable locking and removal means includes a slide ring having a profile whose faces are in excess of the faces of said casing polygonal peripheral profile thereby effecting locking engagement between less than all of said faces.

12. The power wrench as defined in claim 3 wherein said slidable nonrotatable locking and removal means includes a slide ring having an inner double hexagonal profile.

13. The power wrench as defined in claim 3 wherein said slidable nonrotatable locking and removal means includes a slide ring, a said support foot is generally triangular and includes two legs diverging toward said slide ring, and said slide ring has an inner profile adapted to lockingly engage with said outer peripheral profile of said casing.

14. A power wrench comprising driving unit means for driving a wrench head, a casing for said driving unit means, a support foot carried nonrotatably by said casing for offsetting reaction forces created by said driving unit means, a pressure member, means for defining a spherical ball and socket connection between said pressure member and said support foot whereby said pressure member automatically assumes a position in total contact with a support surface to avoid local peak stresses during the operation of said power wrench, said casing includes a polygonal peripheral profile, and said support foot includes a slide ring having a profile whose faces are in excess of the faces of said casing polygonal peripheral profile thereby effecting locking engagement between less than all of said faces.

15. The power wrench as defined in claim 14 wherein said support foot is generally triangular and includes two legs diverging toward a slide ring having an inner profile adapted to lockingly engage with an outer peripheral profile of said casing.

16. A power wrench comprising driving unit means for driving a wrench head, a casing for said driving unit means, a support foot carried nonrotatably by said casing for offsetting reaction forces created by said driving unit means, a pressure member, means for defining a spherical ball and socket connection between said pressure member and said support foot whereby said pressure member automatically assumes a position in total contact with a support surface to avoid local peak stresses during the operation of said power wrench, said casing includes a polygonal peripheral profile, and said support foot includes a slide ring having an inner double hexagonal profile.

17. The power wrench as defined in claim 16 wherein said support foot is generally triangular and includes two legs diverging toward a slide ring having an inner profile adapted to lockingly engage with an outer peripheral profile of said casing.

18. A power wrench comprising a driving unit means for rotating a connecting element adapted to be connected to a wrench head or the like, a casing for said driving unit means, a support foot carried nonrotatably by said casing for offsetting reaction forces created by said driving unit means, said casing includes a polygonal peripheral profile, said support foot includes a slide ring having a polygonal peripheral profile to lockingly engage with at least portions of said casing polygonal peripheral profile, and said slide ring profile is defined by a plurality of faces which are in excess of the faces of said casing polygonal peripheral profile thereby effecting locking engagement between less than all of said faces.

19. The power wrench as defined in claim 18 wherein said connecting element has an axis of rotation about which it is rotated by said driving unit means, and faces defining said casing polygonal peripheral profile are disposed in a plane transverse to said connecting element axis.

20. A power wrench comprising a driving unit means for rotating a connecting element adapted to be connected to a wrench head or the like, a casing for said driving unit means, a support foot carried nonrotatably by said casing for offsetting reaction forces created by said driving unit means, said casing includes a polygonal peripheral profile, said support foot includes a slide ring having a polygonal peripheral profile to lockingly engage with at least portions of said casing polygonal peripheral profile, and said slide ring polygonal profile is a double hexagonal profile.

21. The power wrench as defined in claim 20 wherein said connecting element has an axis of rotation about which it is rotated by said driving unit means, and faces defining said casing polygonal peripheral profile are disposed in a plane transverse to said connecting element axis.

* * * * *